US009461395B2

(12) United States Patent
Kataoka et al.

(10) Patent No.: US 9,461,395 B2
(45) Date of Patent: Oct. 4, 2016

(54) LEVER-TYPE CONNECTOR

(71) Applicant: Sumitomo Wiring Systems, Ltd., Yokkaichi, Mie (JP)

(72) Inventors: Shigeto Kataoka, Mie (JP); Hideto Nakamura, Mie (JP)

(73) Assignee: SUMITOMO WIRING SYSTEMS, LTD (JP)

( * ) Notice: Subject to any disclaimer, the term of this patent is extended or adjusted under 35 U.S.C. 154(b) by 0 days.

(21) Appl. No.: 14/955,131

(22) Filed: Dec. 1, 2015

(65) Prior Publication Data

US 2016/0190727 A1 Jun. 30, 2016

(30) Foreign Application Priority Data

Dec. 26, 2014 (JP) ..... 2014-264511

(51) Int. Cl.
*H01R 13/62* (2006.01)
*H01R 13/502* (2006.01)
*H01R 13/629* (2006.01)

(52) U.S. Cl.
CPC ..... *H01R 13/502* (2013.01); *H01R 13/62938* (2013.01); *H01R 13/62955* (2013.01)

(58) Field of Classification Search
USPC ..... 439/157
See application file for complete search history.

(56) References Cited

U.S. PATENT DOCUMENTS 6,602,082 B2 * 8/2003 Nishide ..... H01R 13/62955 439/157

FOREIGN PATENT DOCUMENTS

JP 2012-243669 12/2012

* cited by examiner

*Primary Examiner* — Tho D Ta
(74) *Attorney, Agent, or Firm* — Gerald E. Hespos; Michael J. Porco; Matthew T. Hespos

(57) ABSTRACT

A lever (30) is supported on a first housing (10) for rotation between an initial position and a connection position. A resiliently deflectable holding arm (35) is formed on a main body (31) of the lever (30) and is configured to be locked to the first housing (10) for holding the lever (30) at the initial position so that the lever (30) does not rotate toward the connection position (connecting direction B). The holding arm (35) is formed with a regulating projection (38). The main body (31) is formed with a stopper (39) configured to regulate a displacement in a hold releasing direction A of separating the holding arm (35) from the first housing (10) by locking the regulating projection (38) when the main body portion (31) is displaced in the connecting direction B with the holding arm (35) locked to the first housing (10).

2 Claims, 6 Drawing Sheets

LEVER-TYPE CONNECTOR

BACKGROUND

1. Field of the Invention

The invention relates to a lever-type connector.

2. Description of the Related Art

Japanese Unexamined Patent Publication No. 2012-243669 discloses a structure for holding a lever in a temporarily locked state and preventing the lever from rotating in a connecting direction. The lever is mounted rotatably on a first housing and has a temporary locking resilient piece that is locked temporarily to a holding portion on the first housing before the first and second housings are connected. A temporary locking releasing portion on the second housing deflects the temporary locking resilient piece when the connection of the first and second housings is started. In this way, the lever is released from the temporarily locked state and can rotate in the connecting direction.

A clearance is formed between the temporary locking resilient piece and a main body of the lever to allow the resilient deflection of the temporary locking resilient piece. A rotational force in the connecting direction could be applied to the main body with the lever temporarily locked, and could cause the temporary locking resilient piece to approach the main body. At this time, the temporary locking resilient piece is pressed strongly against the temporarily locked state holding portion and could be displaced in a direction to release temporary locking, thereby enabling the lever to rotate in the connecting direction.

The invention was completed based on the above situation and aims to improve the reliability of a function of regulating the rotation of a lever.

SUMMARY

The invention is directed to a lever-type connector with a first housing. A lever including a main body is supported on the first housing and is rotatable between an initial position and a connection position. A resiliently deflectable holding arm is formed on the main body and is configured to be locked to the first housing for holding the lever at the initial position so that the lever does not rotate toward the connection position. A second housing is connectable to the first housing and has a releasing portion configured to deflect the holding arm in a hold releasing direction for separating the holding arm from the first housing as the connection of the first and second housings is started. A regulating projection is formed on the holding arm, and a stopper is formed on the main body. The stopper is configured to regulate a displacement of the holding arm in the hold releasing direction by locking the regulating projection when the main body is displaced in a connecting direction with the holding arm locked to the first housing.

The regulating projection locks the stopper when the main body is displaced in the connecting direction with the holding arm locked to the first housing. Thus, the holding arm is locked to the first housing with the displacement in the hold releasing direction restricted so that the lever cannot rotate to the connection position. Thus, the lever-type connector reliably regulates rotation of the lever.

At least one of the regulating projection and the stopper may be formed with a guiding surface inclined with respect to a rotating direction of the lever and configured to guide the regulating projection and the stopper into a locked state. Accordingly, the regulating projection and the stopper are locked reliably.

DETAILED DESCRIPTION

Figure 1:
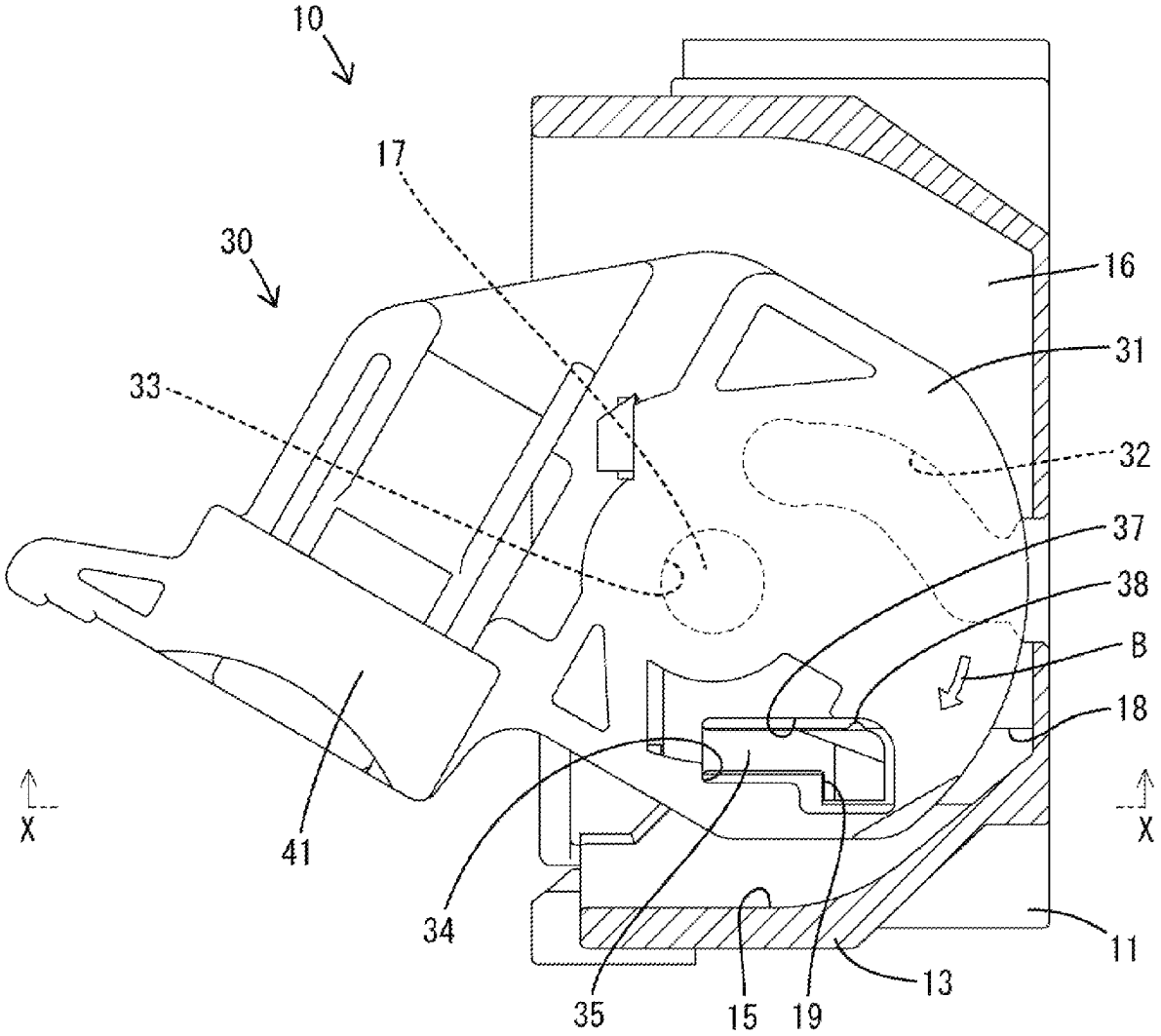
FIG. 1 is a partially cut-away plan view of a first housing constituting a lever-type connector of one embodiment.
Figure 2:
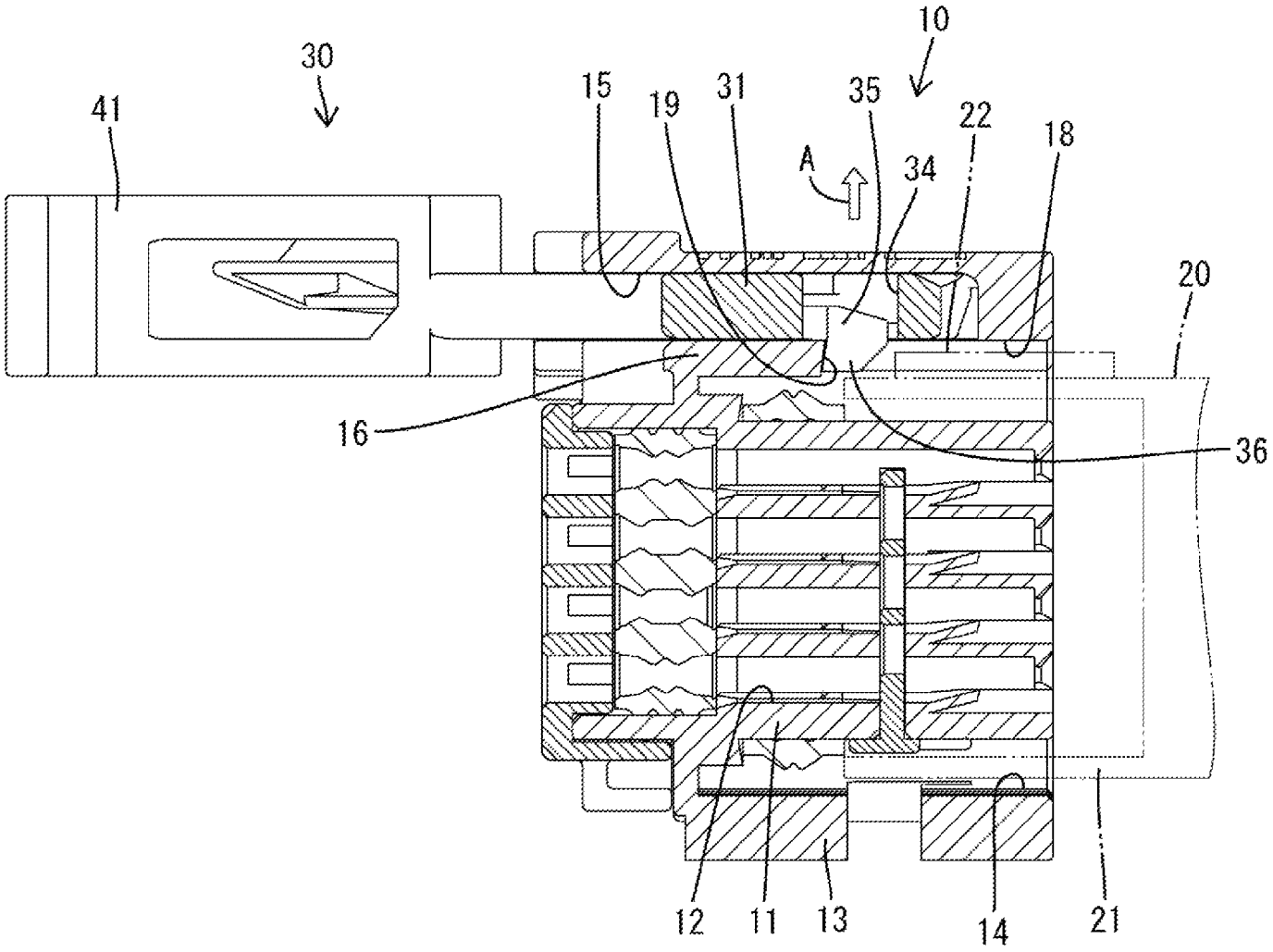
FIG. 2 is a section along X-X of FIG. 1.

A lever-type connector according to an embodiment of the invention includes a first housing 10, a second housing 20 and a lever 30 for connecting the two housings 10, 20, as shown in FIG. 1. As shown in FIG. 2, the first housing 10 is formed integrally to include a terminal accommodating portion 11 formed with terminal accommodating chambers 12 inside and a tubular fitting 13 in the form of a rectangular tube surrounding the terminal accommodating portion 11 over the entire circumference. The terminal accommodating portion 11 and the tubular fitting 13 are connected at rear end parts thereof and a rectangular tube-shaped space between the outer periphery of the terminal accommodating portion 11 and the inner periphery of the tubular fitting 13 serves as a connection space 14 into which a receptacle 21 of the second housing 20 is to be inserted.

Out of four wall portions constituting the tubular fitting portion 13, an accommodation space 15 for accommodating the lever 30 is formed in the wall portion facing the upper surface of the terminal accommodating portion 11. The accommodation space 15 is open on the rear end surface of the first housing 10. A supporting shaft 17 (see FIG. 1) projecting upwardly (in a direction perpendicular to a connecting direction of the two housings 10, 20) from a separation wall portion 16 dividing the accommodation space 15 and the connection space 14 is formed in the accommodation space 15. A communication groove 18 for allowing communication between the accommodation space 15 and the connection space 14 is formed in the separation wall portion 16, and a part of the inner surface of the communication groove 18 serves as a holding locking surface 19 for locking a holding arm 35 to be described later.

The lever 30 is a single component made of synthetic resin and in the form of a single plate. The lever 30 includes a main body 31 formed with a cam groove 32 on the lower surface and the holding arm 35. A bearing recess 33 is formed substantially in a central part of the lower surface of the main body 31. The lever 30 rotates about the supporting shaft 17 between an initial position (see FIG. 1) and a connection position (not shown) displaced clockwise from the initial position in FIG. 1 by fitting the bearing recess 33 to the supporting shaft 17. Since the supporting shaft 17 is arranged in the accommodation space 15, an area of the main body 31 including the cam groove 32 and the entire holding arm 35 are accommodated in the accommodation space 15. An operating portion 41 formed on the outer periphery of the main body 31 projects from the accommodation space 15 and is arranged behind the rear end surface of the first housing 10.

A plate thickness (vertical dimension) of the main body 31 is set to be equal to or slightly smaller than a height (vertical dimension) of the accommodation space 15. Thus, by bringing both upper and lower surfaces of the lever 30 into contact with both upper and lower surfaces of the accommodation space 15, the lever 30 is prevented from being displaced or inclined in a vertical direction (direction perpendicular to both the connecting direction of the two housings 10, 20 and a rotating direction of the lever 30).

The main body 31 is formed with a slit-like cut portion 34 penetrating from the upper surface to the lower surface of the main body portion 31 and cut along a folded path. An area surrounded by this cut portion 34 serves as the holding arm 35. The holding arm 35 is cantilevered forward with the lever 30 located at the initial position. As shown in FIG. 2, a holding projection 36 projecting downwardly is formed on an extending end part of the holding arm 35. The projection 36 comes into contact with the holding locking surface 19 substantially in the same direction as a displacing direction of the holding arm 35 when the lever 30 starts rotating in a connecting direction B (direction from the initial position toward the connection position).

Accordingly, with the lever 30 at the initial position, the holding projection 36 is in contact with the holding locking surface 19 of the first housing 10 from the front, and the lever 30 is held so as not to rotate in the connecting direction B. Further, when the holding arm 35 is deflected resiliently in a releasing direction A (up) as shown in FIG. 2, the holding projection 36 disengages from the holding locking surface 19 and a holding state by the holding arm 35 is released.

In connecting the two housings 10, 20, the lever 30 is held at the initial position by locking between the holding arm 35 and the holding locking surface 19. Subsequently, the receptacle 21 of the second housing 20 is shallowly inserted into the connection space 14 and a cam follower (not shown) on the upper surface of the receptacle 21 is inserted into the entrance of the cam groove 32. Then, as shown in FIG. 2, a releasing portion 22 in the form of a projection formed on the upper surface of the receptacle 21 comes into contact with the holding projection 36 to resiliently deflect the holding arm 35 in the hold releasing direction A, wherefore the lever 30 is made rotatable in the connecting direction B. Thereafter, when the lever 30 is rotated in the connecting direction B, the connection of the two housings 10, 20 proceeds by a cam action by the engagement of the cam groove 32 and the cam follower. When the lever 30 reaches the connection position, the two housings 10, 20 are in a connection completed state.

Figure 4:
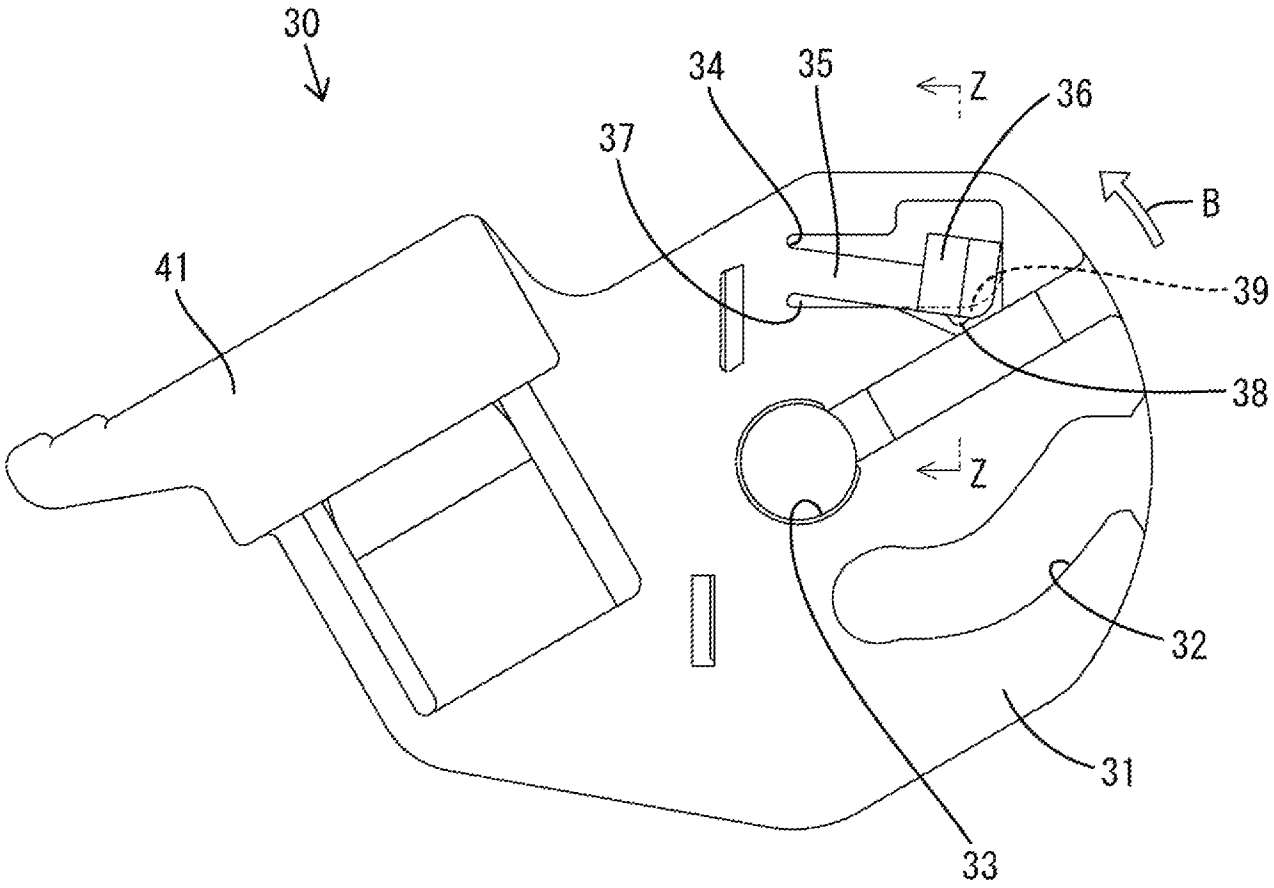
FIG. 4 is a bottom view of the lever showing a state where the main body portion is relatively displaced in the connecting direction with respect to the holding arm.
Figure 6:
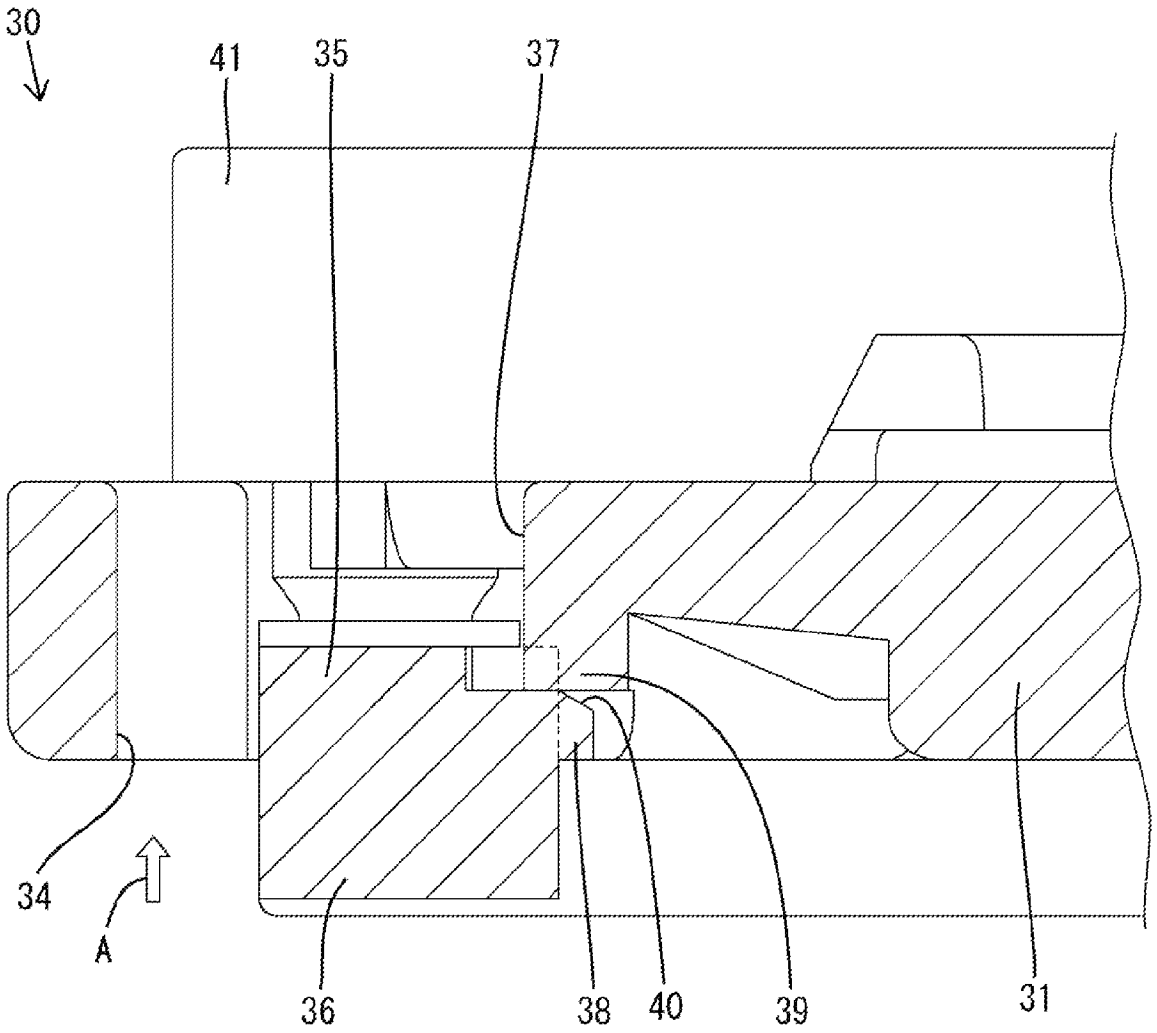
FIG. 6 is a section along Z-Z of FIG. 4 showing the bottom surface facing down.

As described above, the holding arm 35 is surrounded by the cut portion 34 and allowed to be resiliently deflected in the hold releasing direction A (vertical direction) by this cut portion 34. However, this cut portion 34 is also a space for allowing the main body portion 31 and the holding arm 35 to be relatively displaced in the same direction as the rotating direction of the lever 30. Thus, if a rotational force in the connecting direction B is forcibly applied to the main body portion 31 with the holding arm 35 locked to the holding locking surface 19 to hold the lever 30 at the initial position, the main body 31 approaches the holding arm 35 while narrowing a slit 37 constituting the cut portion 34 as shown in FIGS. 4 and 6.

At this time, the holding projection 36 of the holding arm 35 is pressed strongly against the holding locking surface 19 and may be displaced in the hold releasing direction A while causing the holding projection 36 thereof to slide in contact with the holding locking surface 19. If the holding arm 35 is deformed resiliently in the hold releasing direction A, locking between the holding projection 36 and the holding locking surface 19 is released, and the lever 30 can rotate in the connecting direction B. As a countermeasure against this, the holding arm 35 is formed with a regulating projection 38 and the main body 31 is formed with a stopper 39, as shown in FIG. 4.

Figure 3:
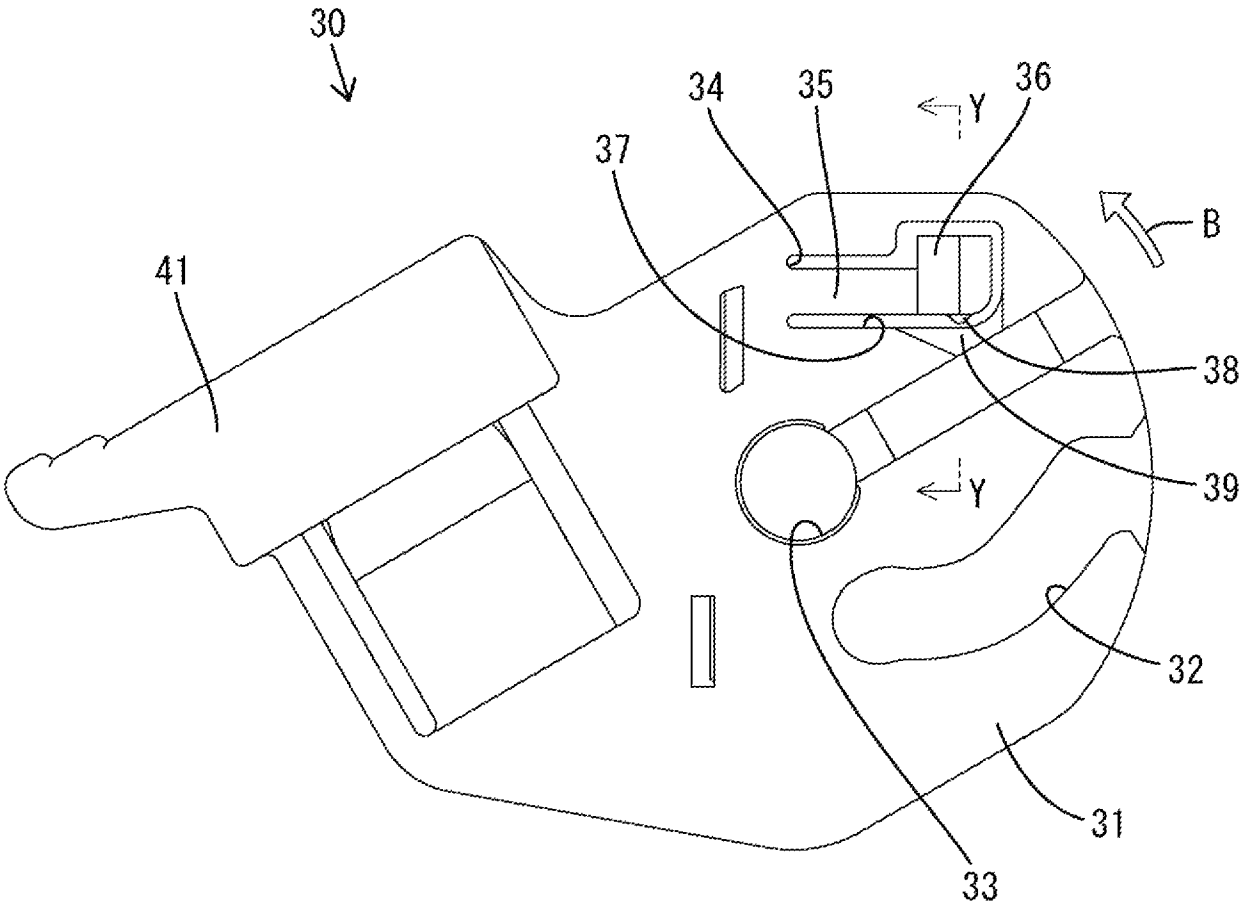
FIG. 3 is a bottom view of a lever showing a state where a main body portion is not relatively displaced in a connecting direction with respect to a holding arm.

The regulating projection 38 is arranged on the extending end part of the holding arm 35. The holding arm 35 includes a side edge facing the slit 37 narrowed when the main body 31 is relatively displaced in the connecting direction B while approaching the holding arm 35. This side edge extends in an extending direction of the holding arm 35. The regulating projection 38 projects from the side edge on a tip part of the holding arm 35 in the extending direction. Note that the holding arm 35 is resiliently deflectable in the hold releasing direction A without causing the regulating projection 38 to interfere with the main body 31 as shown in FIG. 3 in a state where the main body 31 is not displaced toward a rotation position with respect to the holding arm 35.

The stopper 39 is formed by recessing an area of an inner surface of the cut portion 34 facing the regulating projection 38 across the slit 37 and faces opposite to the hold releasing direction A along the vertical direction. In the vertical direction (direction parallel to the hold releasing direction A), the stopper 39 is farther up (i.e. direction opposite to the hold releasing direction A) than the regulating projection 38 when the holding arm 35 is not deflected. This causes the regulating projection 38 to contact or proximately face the stopper 39 from below when the main body 31 is displaced in the connecting direction B with respect to the holding arm 35.

In this state, the holding arm 35 cannot be resiliently deflected in the hold releasing direction A (upwardly). A direction in which the main body 31 is displaced in the connecting direction B with respect to the holding arm 35 and a direction in which the holding projection 36 of the holding arm 35 comes into contact with the holding locking surface 19 are substantially perpendicular to each other. Thus, even if the main body 31 is displaced in the connecting direction B with respect to the holding arm 35, a state where the holding projection 36 is in contact with the holding locking surface 19 is maintained and the lever 30 is held at the initial position with the rotation in the connecting direction B regulated.

Figure 5:
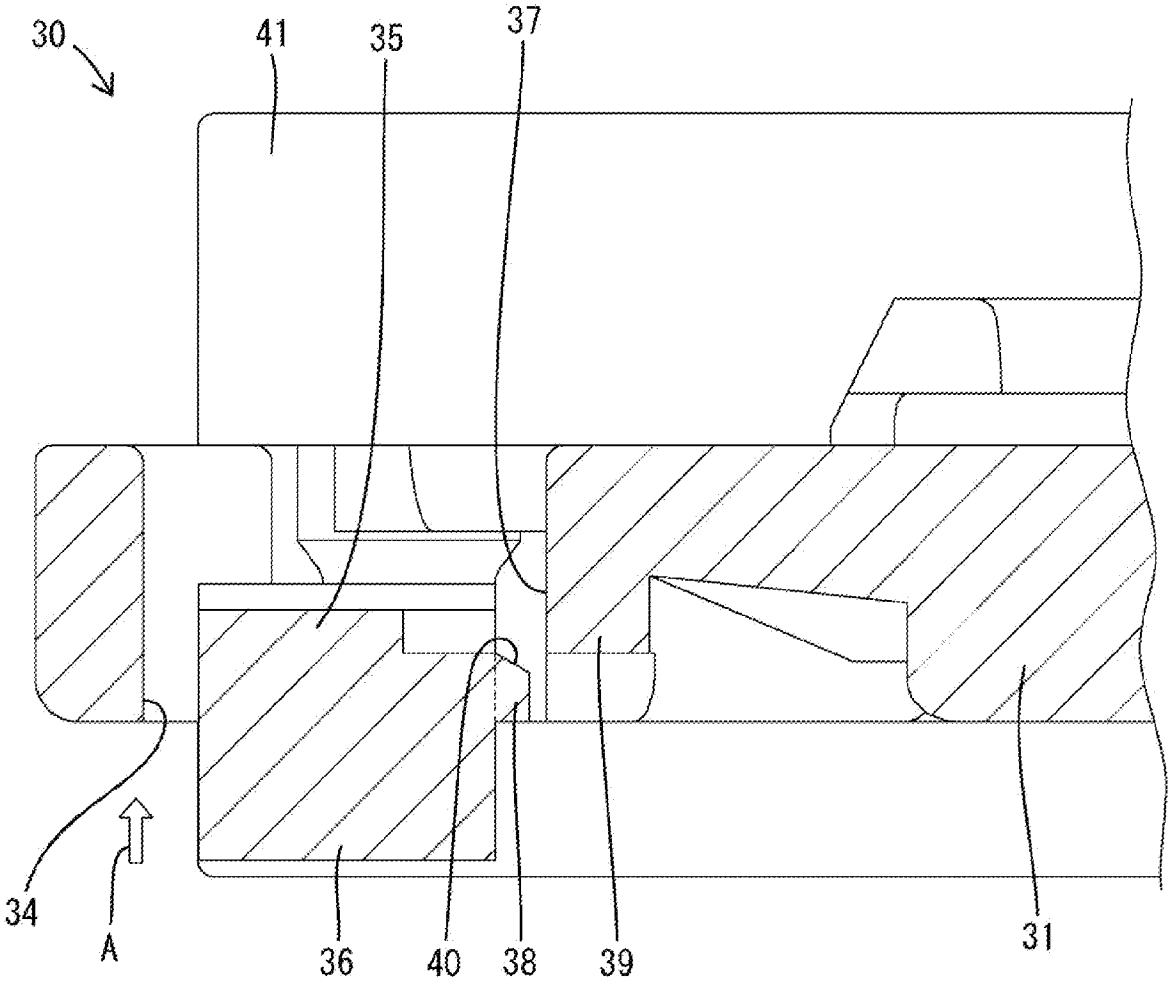
FIG. 5 is a section along Y-Y of FIG. 3 showing a state where a bottom surface faces down.

A guiding surface 40 inclined with respect to the rotating direction of the lever 30 (i.e. direction in which the main body 31 is displaced in the connecting direction B with respect to the holding arm 35) is formed on the upper surface of the regulating projection 38 (see FIGS. 5 and 6). This guiding surface 40 is formed to obliquely face the stopper 39. Thus, even if there is an error in a vertical positional relationship between the regulating projection 38 and the stopper 39 in relatively displacing the main body 31 in the connecting direction B, there is no possibility that the main body 31 butts against the projecting end of the regulating projection 38.

The lever-type connector of this embodiment includes the first housing 10 and the second housing 20 to be connected by the lever 30, and the lever 30 is rotatable between the initial position and the connection position by supporting the main body 31 thereof on the first housing 10. The holding arm 35 is resiliently deflectably formed on the main body 31. The holding arm 35 holds the lever 30 at the initial position so that the lever 30 does not rotate in the connecting direction B by being locked to the holding locking surface 19 of the first housing 10. Further, the second housing 20 is formed with the releasing portion 22 for resiliently deflecting the holding arm 35 in the hold releasing direction A of separating the holding arm 35 from the first housing 10 (holding locking surface 19) as the connection of the two housings 10, 20 is started.

The holding arm 35 is formed with the regulating projection 38 and the main body portion 31 is formed with the stopper 39. When the main body 31 is displaced in the connecting direction B with the holding arm 35 locked to the first housing 10 (holding locking surface 19), the stopper 39 locks the regulating projection 38, thereby regulating a displacement of the holding arm 35 in the hold releasing direction A. Since the holding arm 35 with the displacement in the hold releasing direction A regulated is held in a state locked to the first housing 10 (holding locking surface 19) in this way, there is no possibility that the lever 30 rotates to the connection position. Thus, the lever-type connector of this embodiment is excellent in the reliability of a function of regulating the rotation of the lever 30.

The regulating projection 38 is formed with the guiding surface 40 inclined with respect to the rotating direction of the lever 30 and is configured to guide the regulating projection 38 and the stopper 39 into the locked state. According to this configuration, the regulating projection 38 and the stopper 39 can be locked reliably.

The invention is not limited to the above described and illustrated embodiment. For example, the following embodiments also are included in the scope of the invention.

The guiding surface is formed only on the regulating projection in the above embodiment, but may be formed on both the regulating projection and the stopper or only on the stopper.

Although the guiding surface for guiding the regulating projection and the stopper into the locked state is formed in the above embodiment, such a guiding surface may not be formed.

Although the lever is substantially in the form of a single plate in the above embodiment, it may be such that two main body portions are coupled by an operating portion.

Although the holding arm is cantilevered from the main body in the above embodiment, it may be supported on both ends on the main body.

LIST OF REFERENCE SIGNS

10 first housing
20 second housing
22 releasing portion
30 lever
31 main body
35 holding arm
38 regulating projection
39 stopper
40 guiding surface
A hold releasing direction
B connecting direction

What is claimed is:

1. A lever-type connector, comprising:
a first housing;
a lever including a main body supported on the first housing and rotatable between an initial position and a connection position;
a holding arm resiliently deflectably formed on the main body and configured to hold the lever at the initial position so that the lever does not rotate toward the connection position by being locked to the first housing;
a second housing connectable to the first housing;
a releasing portion formed on the second housing and configured to resiliently deflect the holding arm in a hold releasing direction to separate the holding arm from the first housing as connection of the first and second housings is started;
a regulating projection formed on the holding arm; and
a stopper formed on the main body and configured to regulate a displacement of the holding arm in the hold releasing direction by locking the regulating projection when the main body is displaced in a connecting direction with the holding arm locked to the first housing.

2. The lever-type connector of claim 1, wherein at least one of the regulating projection and the stopper is formed with a guiding surface inclined with respect to a rotating direction of the lever and configured to guide the regulating projection and the stopper into a locked state.

* * * * *